US010522020B2

(12) United States Patent
Cooper

(10) Patent No.: US 10,522,020 B2
(45) Date of Patent: Dec. 31, 2019

(54) SYSTEMS AND METHODS FOR SECURING A TRACKING DEVICE TO A MONITORED ENTITY

(71) Applicant: BI Incorporated, Boulder, CO (US)

(72) Inventor: Larry T. Cooper, Berthoud, CO (US)

(73) Assignee: BI Incorporated, Boulder, CO (US)

( * ) Notice: Subject to any disclaimer, the term of this patent is extended or adjusted under 35 U.S.C. 154(b) by 0 days.

(21) Appl. No.: 15/852,795

(22) Filed: Dec. 22, 2017

(65) Prior Publication Data

US 2019/0197860 A1 Jun. 27, 2019

(51) Int. Cl.

| | |
|---|---|
| ***G08B 21/02*** | (2006.01) |
| ***A44B 13/00*** | (2006.01) |
| ***A45F 5/00*** | (2006.01) |

(52) U.S. Cl.

CPC ..... *G08B 21/0288* (2013.01); *A44B 13/0023* (2013.01); *A45F 5/00* (2013.01); *A45F 2200/05* (2013.01); *G08B 21/0269* (2013.01)

(58) Field of Classification Search

CPC ..... G08B 21/0288; G08B 21/0269; A44B 13/0023; A45F 5/00; A45F 2200/05

See application file for complete search history.

(56) References Cited

U.S. PATENT DOCUMENTS

| | | | | |
|---|---|---|---|---|
| 5,298,884 | A | 3/1994 | Gilmore | |
| 5,627,520 | A * | 5/1997 | Grubbs | G07C 9/00111 340/539.1 |
| 5,650,766 | A * | 7/1997 | Burgmann | G08B 21/22 200/DIG. 2 |
| 5,831,535 | A * | 11/1998 | Reisman | G07C 9/00111 340/573.4 |
| 6,693,543 | B1 * | 2/2004 | Stephenson | G08B 21/22 248/220.22 |
| 7,930,927 | B2 | 4/2011 | Cooper et al. | |
| 8,493,219 | B2 | 7/2013 | Buck et al. | |
| 8,576,065 | B2 | 11/2013 | Buck et al. | |
| 8,629,776 | B2 | 1/2014 | Buck et al. | |
| 8,657,744 | B2 | 2/2014 | Rompa et al. | |
| 9,240,118 | B2 | 1/2016 | Melton | |
| 9,241,659 | B2 | 1/2016 | Rompa et al. | |
| 9,626,855 | B2 | 4/2017 | Melton | |
| 9,668,095 | B1 | 5/2017 | Newell et al. | |
| 2009/0051562 | A1 * | 2/2009 | Potter | G08B 21/0286 340/693.5 |
| 2011/0109461 | A1 * | 5/2011 | Aninye | G08B 21/0286 340/573.4 |
| 2011/0154887 | A1 | 6/2011 | Cooper et al. | |
| 2013/0006066 | A1 | 1/2013 | Melton | |
| 2013/0182382 | A1 * | 7/2013 | Vardi | G08B 13/1463 361/679.01 |
| 2015/0048948 | A1 | 2/2015 | Buck et al. | |
| 2015/0061864 | A1 | 3/2015 | Buck et al. | |
| 2015/0078622 | A1 | 3/2015 | Buck et al. | |

(Continued)

OTHER PUBLICATIONS

U.S. Appl. No. 15/280,596, filed Sep. 29, 2016, Buck et al.
U.S. Appl. No. 15/495,365, filed Apr. 24, 2017, Newell et al.

*Primary Examiner* — Robert Sandy
*Assistant Examiner* — David M Upchurch
(74) *Attorney, Agent, or Firm* — HDC IP Law

(57) ABSTRACT

Systems and methods are discussed that are related to monitoring movement, and in particular to systems and methods for securing a monitoring device to a monitor target.

19 Claims, 9 Drawing Sheets

(56) References Cited

U.S. PATENT DOCUMENTS

| | | | | |
|---|---|---|---|---|
| 2015/0131085 | A1 | 5/2015 | Cooper et al. | |
| 2015/0228184 | A1 | 8/2015 | Buck et al. | |
| 2015/0279200 | A1 | 10/2015 | Buck et al. | |
| 2015/0327214 | A1 | 11/2015 | Buck et al. | |
| 2016/0306024 | A1 | 3/2016 | Buck et al. | |
| 2016/0267770 | A1 | 9/2016 | Keays | |
| 2016/0032046 | A1 | 11/2016 | Buck et al. | |
| 2017/0270778 | A1 | 9/2017 | Melton | |
| 2018/0068543 | A1 | 3/2018 | Cooper | |
| 2018/0256074 | A1* | 9/2018 | Persidsky ..... | A61B 5/113 |

* cited by examiner

SYSTEMS AND METHODS FOR SECURING A TRACKING DEVICE TO A MONITORED ENTITY

BACKGROUND OF THE INVENTION

The present invention is related to monitoring movement, and in particular to systems and methods for securing a monitoring device to a monitor target.

Large numbers of individuals are currently housed in prisons. This represents a significant cost to society both in terms of housing expense and wasted productivity. To address this concern, house arrest systems have been developed for use by less violent offenders. This allows the less violent offender to be monitored outside of a traditional prison system and allows the offender an opportunity to work and interact to at least some degree in society. The same approach is applied to paroled prisoners allowing for a monitored transition between a prison atmosphere and returning to society. House arrest systems typically require attaching a monitoring device to a monitored individual. Such devices may be defeated through tampering, and as such the ability to monitor the individuals may be defeated.

Thus, for at least the aforementioned reasons, there exists a need in the art for more advanced approaches, devices and systems for individual monitoring.

BRIEF SUMMARY OF THE INVENTION

The present invention is related to monitoring movement, and in particular to systems and methods for securing a monitoring device to a monitor target.

Various embodiments of the present invention provide monitoring systems. The monitoring systems include a strap, a male connector, and an interfering element. The strap includes an optical path separated by an opening. The male connector includes an optical bridge that when inserted in the opening provides an optical bridge connecting to the optical path. The interfering element is operable to block light transmitted along the optical path when the male connector is not inserted in the opening.

This summary provides only a general outline of some embodiments according to the present invention. Many other objects, features, advantages and other embodiments of the present invention will become more fully apparent from the following detailed description, the appended claims and the accompanying drawings and figures.

BRIEF DESCRIPTION OF THE DRAWINGS

A further understanding of the various embodiments of the present invention may be realized by reference to the figures which are described in remaining portions of the specification. In the figures, similar reference numerals are used throughout several drawings to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION OF THE INVENTION

Figure 1A:
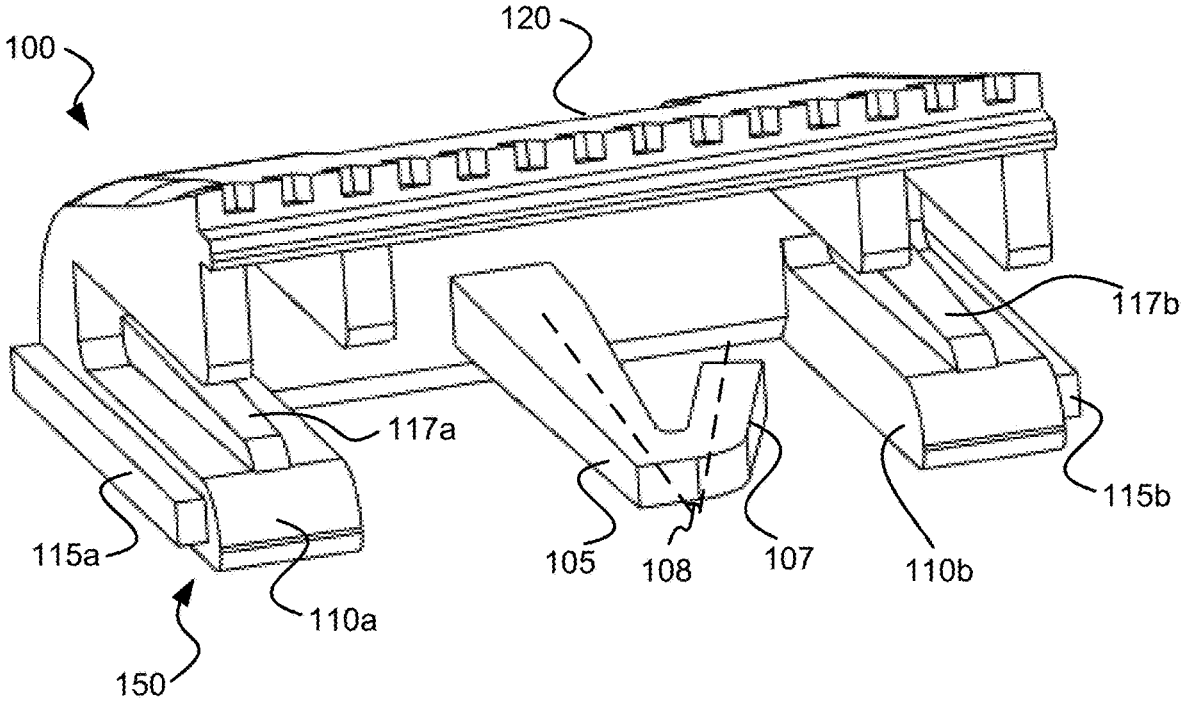
FIGS. 1*a*-1*b* depict a strap securing clamp including a single, horizontal reverse prong catch in accordance with one or more embodiments of the present inventions.

The present invention is related to monitoring movement, and in particular to systems and methods for securing a monitoring device to a monitor target.

Various embodiments of the present inventions provide monitoring systems that include: a monitor device, a strap, and a strap securing clamp. The monitor device includes at least one strap post and at least one catch post, and the strap has a hole that is placed over the strap post. The strap securing clamp includes a reverse prong catch having at least one prong. The prong extends past the catch post securing the strap securing clamp in place relative to the monitor device.

In some instances of the aforementioned embodiments, the prong is made of a material sufficiently flexible to allow the prong to deform during installation of the strap securing clamp and to return to an original orientation once the prong extends past the catch post. In particular instances, the material is plastic.

In various instances of the aforementioned embodiments, the prong extends away from the reverse prong catch less than ninety degrees. In more particular embodiments, the prong extends away from the reverse prong catch less than seventy degrees. In yet more particular embodiments, the prong extends away from the reverse prong catch less than forty-five degrees.

In one or more instances of the aforementioned embodiments, the strap securing clamp further includes a thin walled area having a thinner wall than a surrounding portion of the strap securing clamp. In some cases, the reverse prong catch is exposable via the thin walled area. In various instances of the aforementioned embodiments, de-installing the strap securing clamp includes severing the reverse prong catch from the strap securing clamp. In some instances of the aforementioned embodiments, the prong of the reverse prong catch is a first prong, and the reverse prong catch further includes a second prong extending from the reverse prong catch in a direction opposite that of the first prong. In some cases, the prong extends a direction from the reverse prong catch in either a horizontal or vertical direction relative to the strap securing clamp.

Other embodiments of the present inventions provide methods for securing a monitor device to a monitor target. The methods include: providing a monitor device that includes at least one strap post and at least one catch post; sliding a strap over the strap post such that a hole in the strap surrounds the strap post; installing a strap securing clamp into the monitor device such that the strap securing clamp holds the strap with the hole over the strap post. A reverse prong catch of the strap deforms during installation to allow a prong of the reverse prong catch to extend past the catch post, and after the prong extends past the catch post the prong returns to an original orientation.

In some instances of the aforementioned embodiments, the prong extends away from the reverse prong catch less than ninety degrees in the original orientation. In various instances of the aforementioned embodiments, the prong extends away from the reverse prong catch less than seventy degrees in the original orientation. In one or more instances of the aforementioned embodiments, the prong extends away from the reverse prong catch less than forty-five degrees in the original orientation. In some instances of the aforementioned embodiments, the strap securing clamp further includes a thin walled area having a thinner wall than a surrounding portion of the strap securing clamp.

In particular instances of the aforementioned embodiments, the methods further include uninstalling the strap securing clamp from the monitor device. Such uninstalling includes: opening a hole in the thin walled area; inserting a tool through the hole in the thin walled area; and severing the reverse prong catch the strap securing clamp.

Figure 1B:
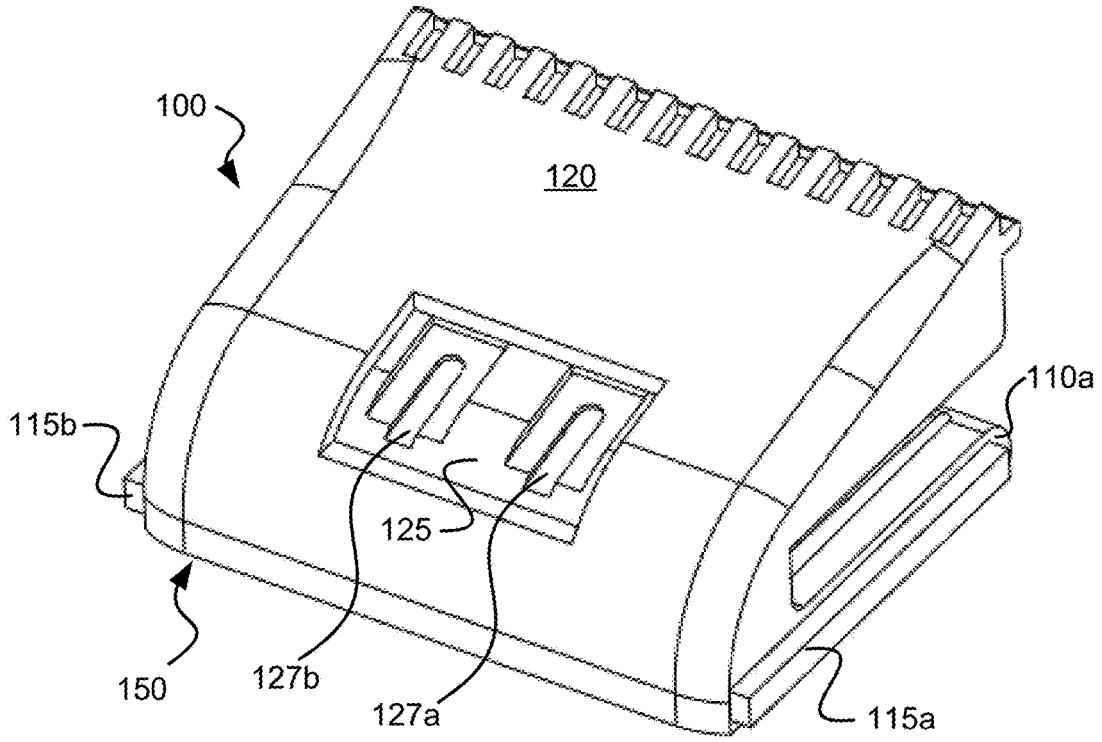

Turning to FIG. 1*a*-1*b*, a front view and a back view of a strap securing clamp 100 are shown. The front view of FIG. 1*a* shows a single, horizontal reverse prong catch 105 in accordance with one or more embodiments of the present inventions. Single, horizontal reverse prong catch 105 is made of a material that is sufficiently flexible to allow at least a prong 107 to deflect or collapse toward the body of single, horizontal reverse prong catch 105 such that it can clear a catch post (not shown). Once prong 107 has cleared the catch post, prong 107 springs (i.e., it has memory causing it to return to its approximate original orientation) back to its original orientation such that strap securing clamp 100 cannot be removed without incurring noticeable damage. In some embodiments, single, horizontal reverse prong catch 105 is made of plastic. Based upon the disclosure provided herein, one of ordinary skill in the art will recognize a variety of materials of which single, horizontal reverse prong catch 105 may be made. In various embodiments, all elements of strap securing clamp 100 is made of a single material. In one particular embodiment, strap securing clamp 100 is molded of plastic. In its original orientation (i.e., before installation and after full insertion), prong 107 extends away from single, horizontal reverse prong catch 105 at an angle 108. In some embodiments, angle 108 is less than ninety degrees. In various embodiments, angle 108 is less than seventy degrees. In particular embodiments, angle 108 is less than forty-five degrees. During installation when pressure is exerted on prong 107, angle 108 reduces substantially as prong 107 deforms or collapses toward the main body of single, horizontal reverse prong catch 105. In one particular embodiment, prong 107 extends away from reverse prong catch 105 less than seventy degrees in an original orientation (non-deformed orientation), and when prong 107 is deformed to extend past the catch post angle 108 reduces to less than thirty degrees. Based upon the disclosure provided herein, one of ordinary skill in the art will recognize a variety of values for angle 108 in both original and deformed orientations.

Strap securing clamp 100 includes a top region 120 and a bottom region 150. As shown in FIG. 1*b*, top region 120 includes a thin walled area 125 with two targets 127*a*, 127*b*. Thin walled area 125 is above a base region of single, horizontal reverse prong catch 105. A tool (not shown) may destroy a portion of thin walled area 125 exposing the base region of single, horizontal reverse prong catch 105. This same tool may then be inserted through the hole made in thin walled area 125 to sever single, horizontal reverse prong catch 105 from strap securing clamp 100. With single, horizontal reverse prong catch 105 severed, strap securing clamp 100 can be removed as it no longer catches on the catch post. This process of removing strap securing clamp 100, while relative simple, leaves obvious evidence of damage that can be discerned by an officer monitoring an individual.

Strap securing clamp 100 further includes support members 110*a*, 110*b* that are designed to rest on a strap (not shown) that is secured by strap securing clamp 100. Guide structures 115*a*, 115*b*, 117*a*, 117*b* are included on respective support members 110 and are used to assure that strap securing clamp 100 is properly aligned with a strap (not shown), monitoring device (not shown), and/or catch post (not shown) with which it is being installed.

Figure 2A:
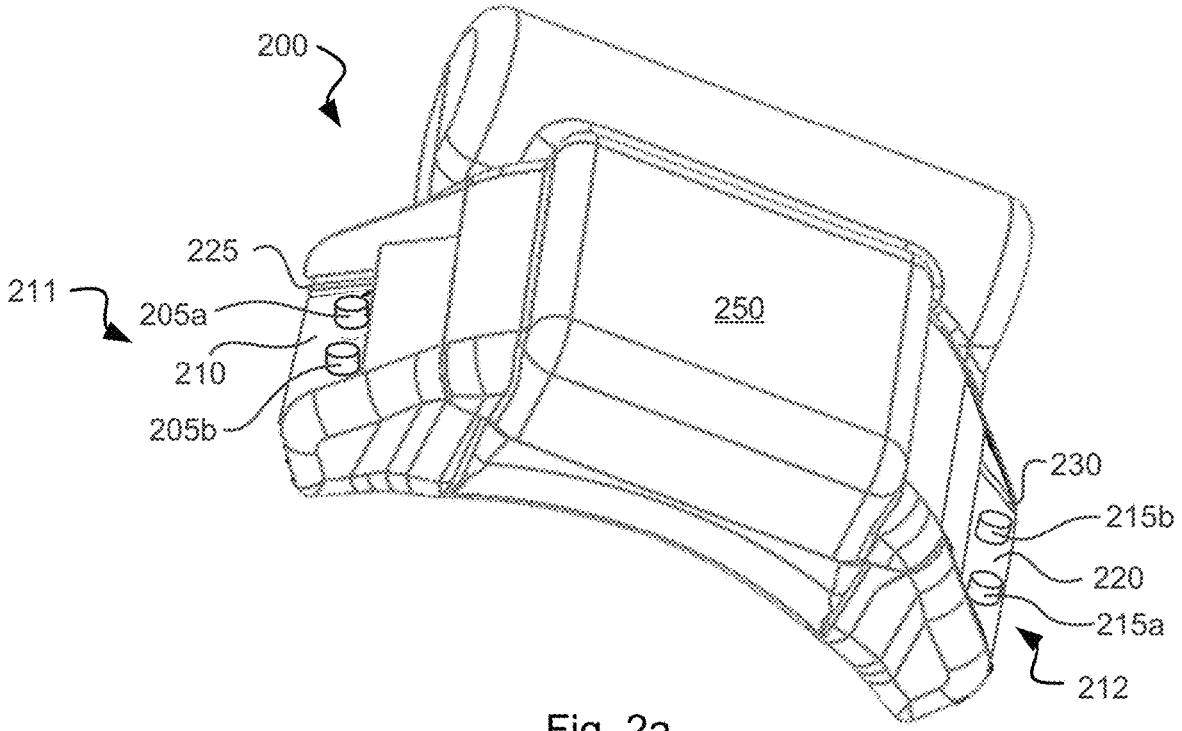
FIGS. 2*a*-2*e* show a mobile tracking device using the strap securing clamp of FIGS. 1*a*-1*b* in accordance with some embodiments of the present inventions.
Figure 2B:
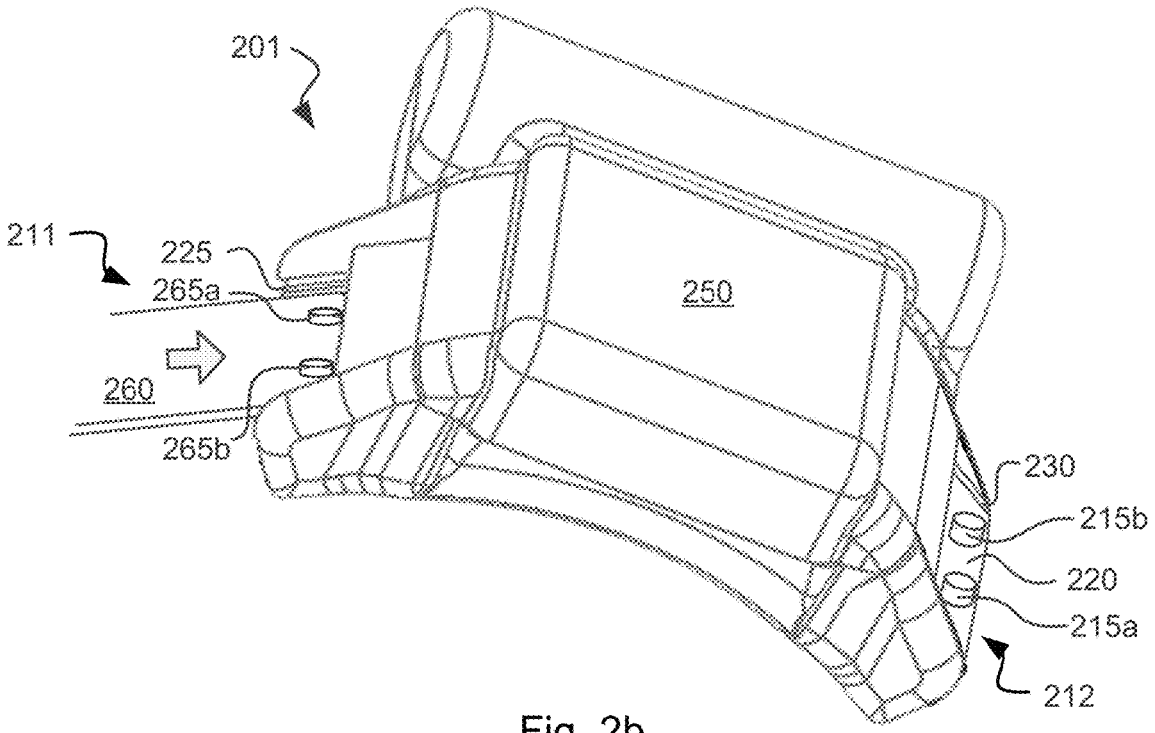
Figure 2C:
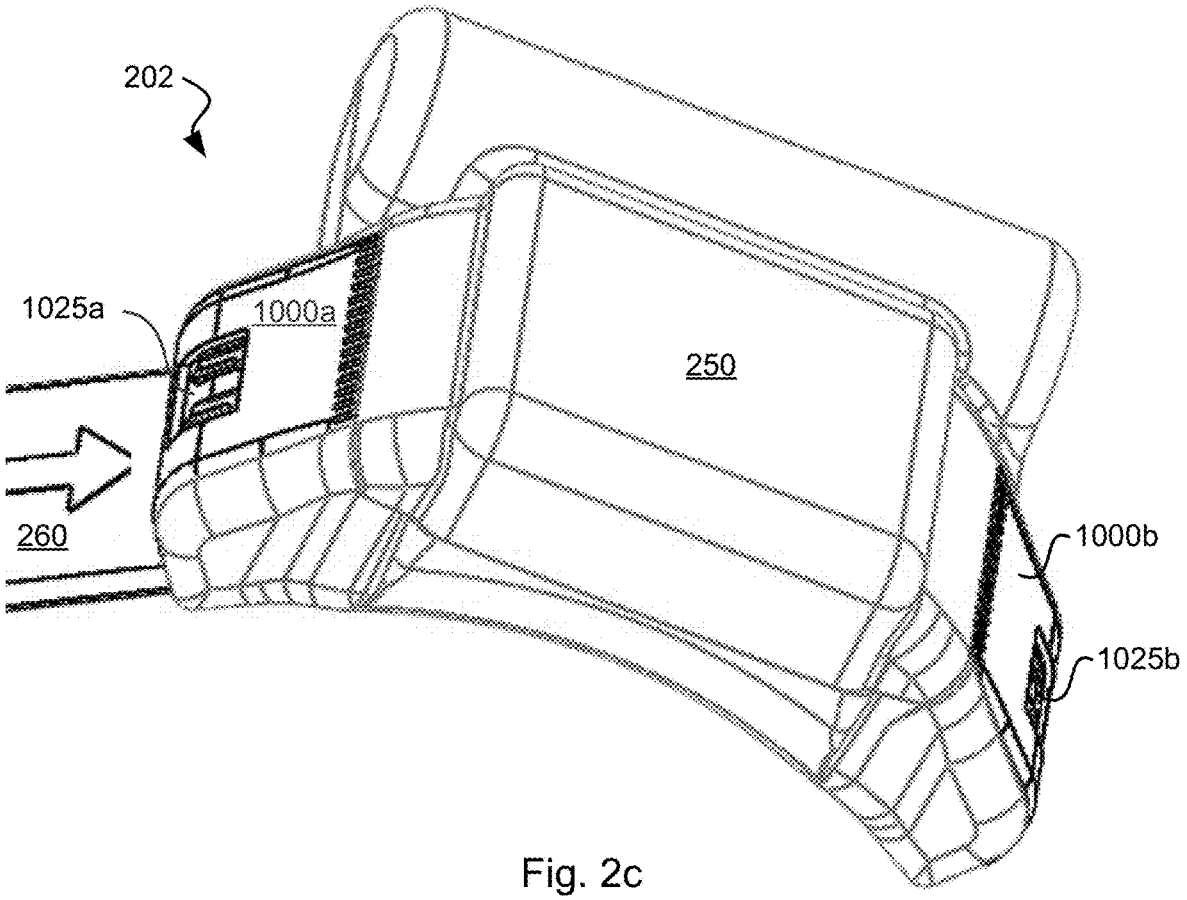

Turning to FIGS. 2*a*-2*e*, a first view 200 of a monitor device 250 is shown in accordance with some embodiments of the present inventions where monitor device 250 is shown prior to installation of a strap (shown as 260 in FIG. 2*b*) and strap securing clamp (shown as 1000*a* and 1000*b* in FIG. 2*c*). Monitor device 250 may be any device known in the art that is designed to be attached to an individual or entity for monitoring. As more fully discussed below in relation to FIG. 7, monitor device 250 may be used as part of a larger monitoring system.

As shown, a monitor device 250 includes a first strap securing area 211 and a second strap securing area 212. First strap securing area includes a planar base 210 on which an inserted strap rests, and two posts 205*a*, 205*b* extending upward from planar base 210. Second strap securing area 212 includes a planar base 220 on which an inserted strap rests, and two posts 215*a*, 215*b* extending upward from planar base 220. An alignment slot 225 is formed in monitor device 250, and is designed to accept a guide structure in a strap securing clamp; and an alignment slot 230 is formed in monitor device 250, and is designed to accept a guide structure in another strap securing clamp.

Turning to FIG. 2*b*, a second view 201 of monitor device 250 is shown where a strap has been placed on planar base 210 such that two holes 265*a*, 265*b* align with posts 205*a*, 205*b*. In particular, posts 205*a*, 205*b* slide through respective ones of holes 265*a*, 265*b*. The interaction of posts 205*a*, 205*b* and holes 265*a*, 265*b* hold strap 260 securely in place.

Turning to FIG. 2*c*, a third view 202 of monitor device 250 is shown where a strap securing clamp 1000*a* is inserted into monitor device 250 such that it covers posts 205*a*, 205*b* and holds strap 260 in place with posts 205*a*, 205*b* through respective ones of holes 265*a*, 265*b*. A thin walled area 1025*a* shields an internal single, horizontal reverse prong catch (shown as 1005 in FIG. 2*d*) that wraps around a catch post (shown as 295 in FIG. 2*d*) included as part of monitor device 250. A similar strap securing clamp 1000*b* with a thin walled area 1025*b* is shown inserted in strap securing area 212. In some cases, strap securing clamps 1000*a*, 1000*b* may be the same as those described in relation to FIGS. 1*a*-1*b* above.

Figure 2D:
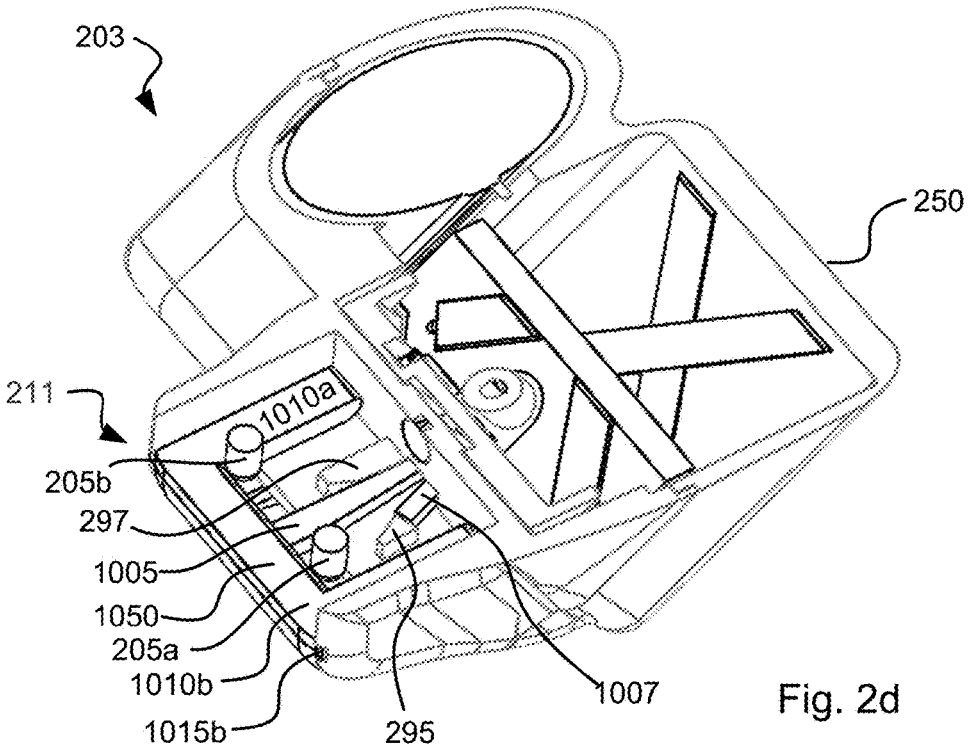

Turning to FIG. 2*d*, a fourth view 203 is shown of monitor device 250. Fourth view 203 particularly shows a cut away view from the bottom where the strap (shown as 260 in FIG. 2*b*) and the planar base (shown as 210 in FIG. 2*a*) removed so that a bottom side 1050 of strap securing clamp 1000*a* can be seen. As shown, support members 1010*a* and 1010*b* are directly over the strap which has been removed so strap securing clamp 1000*a* can be seen, and guide structure 1015*b* slides into a slot in strap securing area 211 of monitor device 250. A single, horizontal reverse prong catch 1005 extends into monitor device 250 such that a prong 1007 catches on catch post 295. When strap securing clamp 1000*a* is partially installed, a combination of the main portion of single, horizontal reverse prong catch 1005 and prong 1007 deform allowing prong 1007 to extend past catch post 295 and into monitor device 250. Once prong 1007 clears catch post 295, the combination of the main portion of single, horizontal reverse prong catch 1005 and prong 1007 that deformed during installation spring back to their normal orientation. In this fully inserted condition, prong 1007 catches on catch post 295 whenever de-insertion pressure is placed on strap securing clamp 1000*a*. As such, strap securing clamp 1000*a* is held securely in position causing holes 265*a*, 265*b* to be held in position over posts 205*a*, 205*b*, and thus maintaining strap 260 securely fixed to monitor device 250 and around the limb of a monitored individual.

Figure 2E:
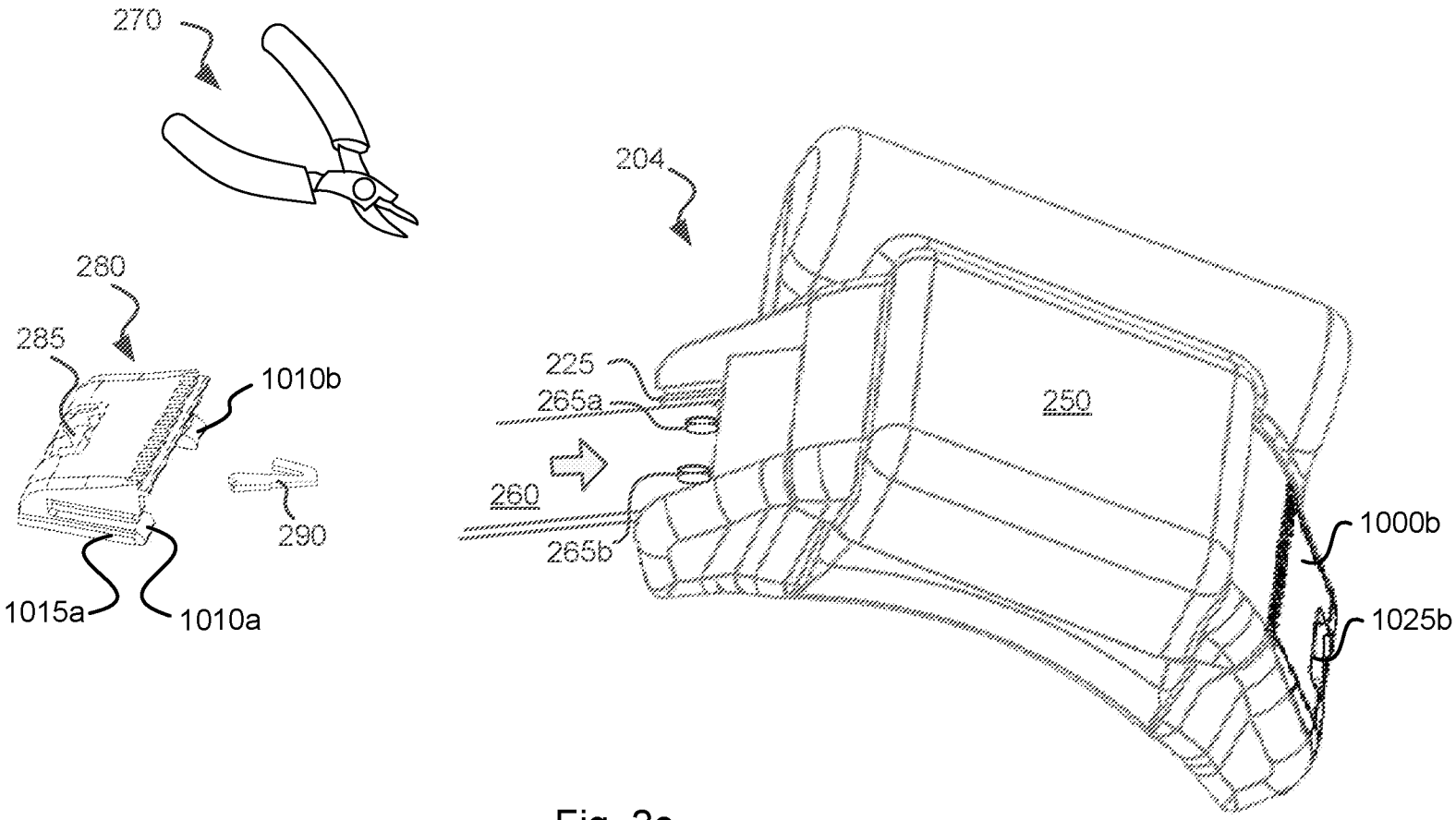

Turning to FIG. 2*e*, a fifth view 204 showing removal of strap 260 from monitor device 250. As shown, a tool 270 is used to cut through thin walled area 1025*a* leaving an opening 285. Such an opening is clear evidence of tampering with strap 260 (and strap securing clamp 1000*a*). Tool 270 is then extended through opening 285 that was previously made in thin walled area 1025*a*, and cuts the main portion of single, horizontal reverse prong catch 1005 leaving a severed catch 290 apart from a now unusable strap securing clamp portion 280. This cutting process allows for strap securing clamp 1000*a* to be removed from monitor device 250 and strap 260 to be unattached from monitor device 250. Again, while the process of removing strap 260 from monitor device 250, the process leave clear evidence of tampering.

Figure 3A:
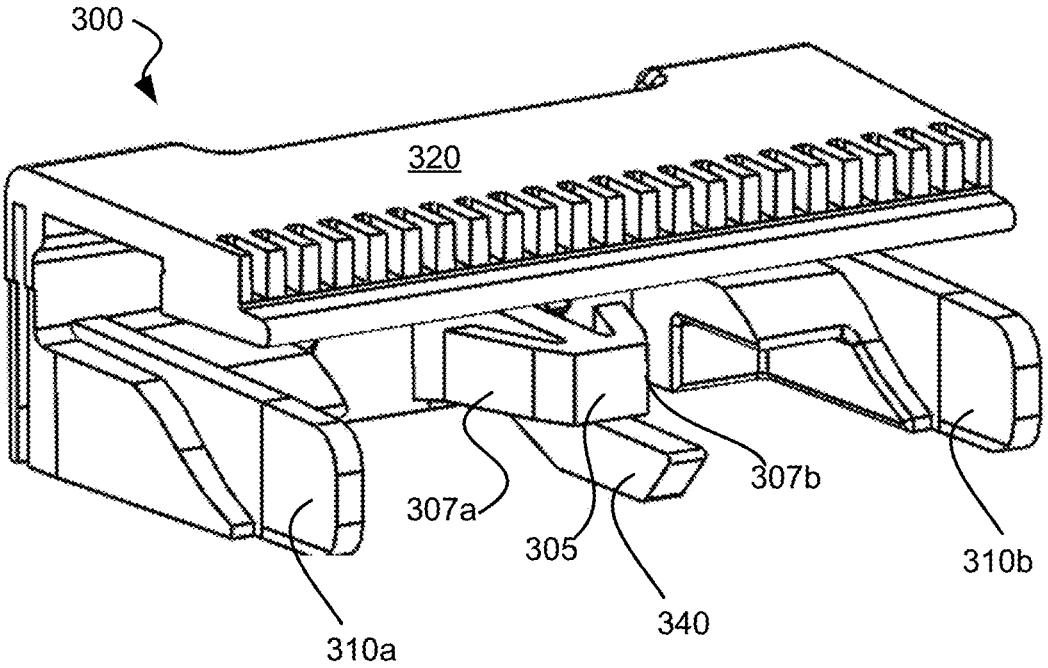
FIGS. 3*a*-3*b* depict another strap securing clamp including a double, horizontal reverse prong catch in accordance with other embodiments of the present inventions.
Figure 3B:
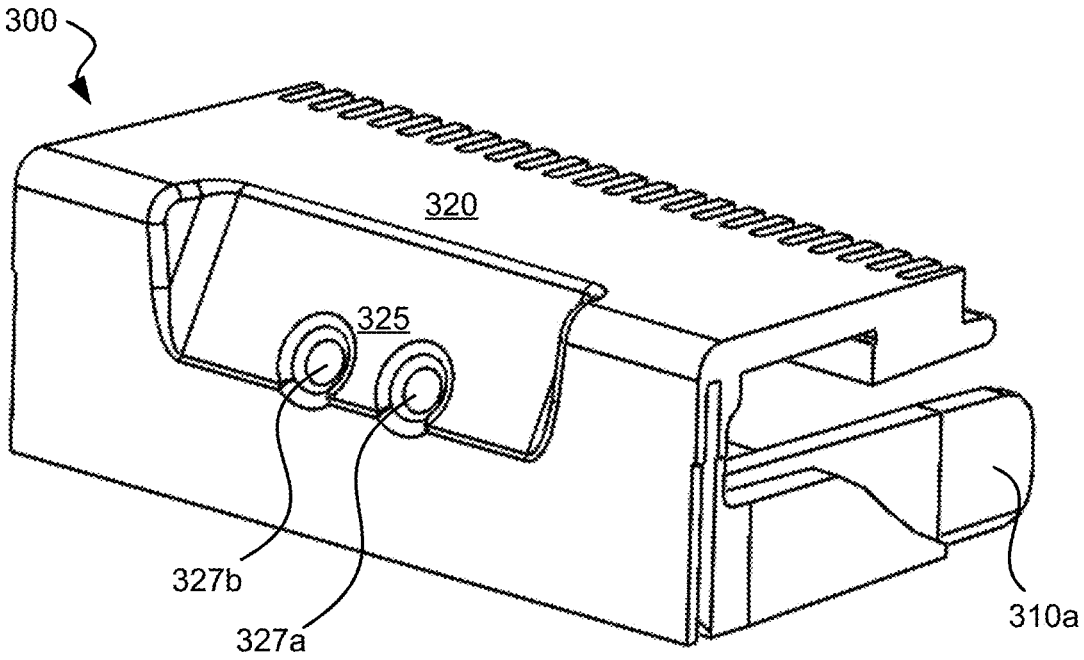

Turning to FIG. 3*a*-3*b*, a front view and a back view of another strap securing clamp 300 are shown. The front view of FIG. 3*a* shows a double, horizontal reverse prong catch 305 in accordance with other embodiments of the present inventions. Double, horizontal reverse prong catch 305 is made of a material that is sufficiently flexible to allow a prongs 307*a*, 307*b* to deflect or collapse toward the body of double, horizontal reverse prong catch 305 such that they can clear respective catch posts (not shown). Once prongs 307*a*, 307*b* have cleared the catch post, prongs 307*a*, 307*b* spring back to its original orientation such that strap securing clamp 300 cannot be removed without incurring noticeable damage. In some embodiments, double, horizontal reverse prong catch 305 is made of plastic. Based upon the disclosure provided herein, one of ordinary skill in the art will recognize a variety of materials of which double, horizontal reverse prong catch 305 may be made. In various embodiments, all elements of strap securing clamp 300 is made of a single material. In one particular embodiment, strap securing clamp 300 is molded of plastic.

Strap securing clamp 300 includes a top region 320 and a bottom region (not shown). As shown in FIG. 3*b*, top region 320 includes a thin walled area 325 with two targets 327*a*, 327*b*. Thin walled area 325 is above a base region of double, horizontal reverse prong catch 305. A tool (not shown) may destroy a portion of thin walled area 325 exposing the base region of single, horizontal reverse prong catch 305. This same tool may then be inserted through the hole made in thin walled area 325 to sever double, horizontal reverse prong catch 305 from strap securing clamp 300. With double, horizontal reverse prong catch 305 severed, strap securing clamp 300 can be removed as it no longer catches on the catch posts. This process of removing strap securing clamp 300, while relative simple, leaves obvious evidence of damage that can be discerned by an officer monitoring an individual. Strap securing clamp 300 further includes support members 310*a*, 310*b*, 340 that are designed to rest on a strap (not shown) that is secured by strap securing clamp 300.

Figure 4A:
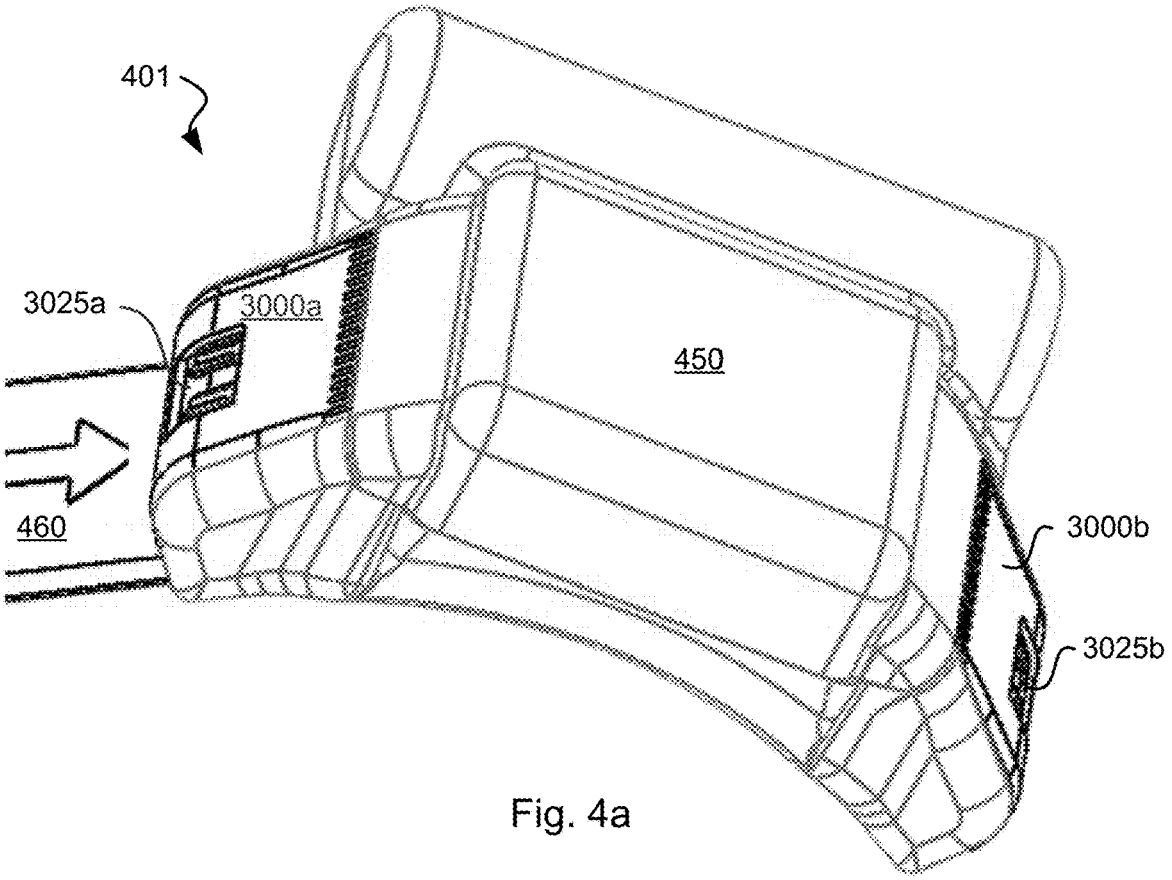
FIGS. 4*a*-4*b* show a mobile tracking device using the strap securing clamp of FIGS. 3*a*-3*b* in accordance with various embodiments of the present inventions.
Figure 4B:
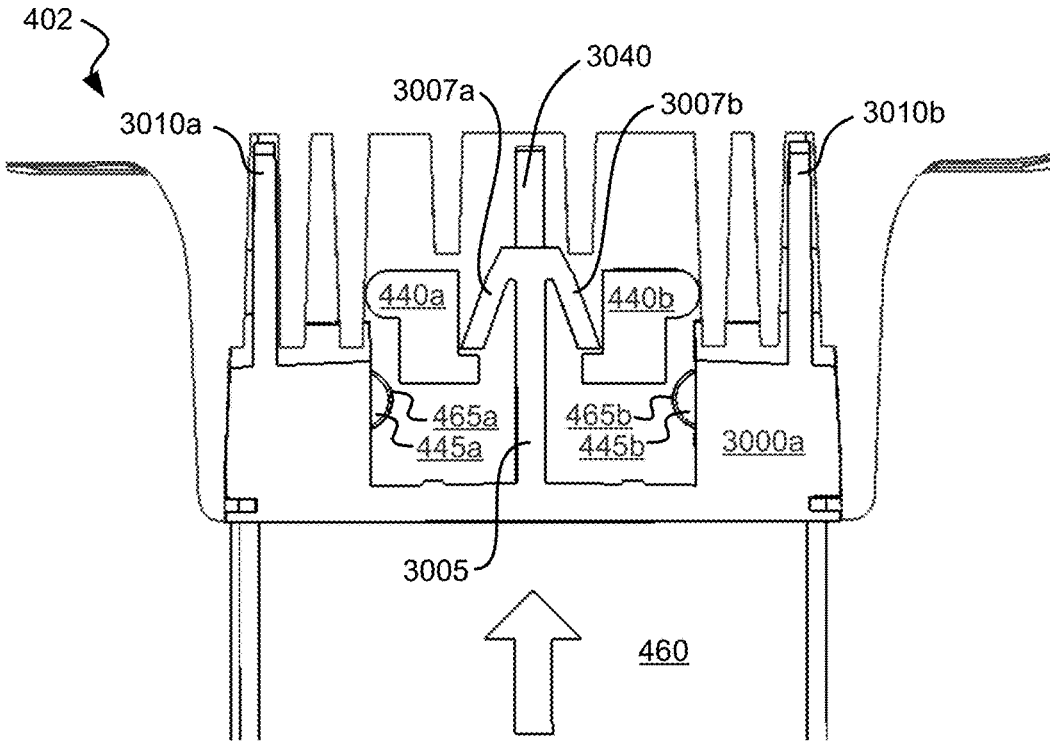

Turning to FIGS. 4*a*-4*b*, a first view 401 of a monitor device 450 where a strap 460 has been installed into monitor device 450 and secured by a strap securing clamp 3000*a* having a thin walled area 3025*a*. Another strap securing clamp 3025*a* having a thin walled area 3025*b* is installed on the opposite side of monitor device 450. While not shown, strap 460 is secured in place by posts extending up from a planar base portion of monitor device 450 similar to that discussed above in relation to FIGS. 2*a*-2*c*. Strap securing clamps 3000*a*, 3000*b* may be similar to the strap securing clamp discussed above in relation to FIGS. 3*a*-3*b*.

Turning to FIG. 4*b*, a second view 402 is shown of monitor device 450. Second view 402 particularly shows a cut away view from the bottom where strap 460 and the planar base portion of monitor device 450 is removed so that the bottom side of strap securing clamp 3000*a* can be seen. As shown, support members 3010*a*, 3010*b*, 3040 are directly over strap 460 which has been cut away so strap securing clamp 3000*a* can be seen. A double, horizontal reverse prong catch 3005 extends into monitor device 450 such that a prong 3007*a* catches on a catch post 440*a* of monitor device 450 and a prong 3007*b* catches on a catch post 440*b* of monitor device 450. When strap securing clamp 3000*a* is partially installed, prongs 3007*a*, 3007*b* deform or collapse toward the main body of double, horizontal reverse prong catch 3005 allowing prongs 3007*a*, 3007*b* to extend past catch posts 440*a*, 440*b* and into monitor device 450. Once prongs 3007*a*, 3007*b* clear catch posts 440*a*, 440*b*, prong 3007*a*, 3007*b* that deformed during installation spring back to their normal orientation. In this fully inserted condition, prong 3007*a* catches on catch post 440*a* and prong 3007*b* catches on catch post 440*b* whenever de-insertion pressure is placed on strap securing clamp 3000*a*. As such, strap securing clamp 3000*a* is held securely in position causing holes 465*a*, 465*b* in strap 460 to be held in position over posts 405*a*, 405*b* (posts 405*a*, 405*b* are connected to monitor device 450), and thus maintaining strap 460 securely fixed to monitor device 450 and around the limb of a monitored individual.

Similar to that described above in relation to FIG. 2*e*, removal of strap 460 includes opening a hole in thin walled area 3025*a*, and then extending a tool through that hole to sever double, horizontal reverse prong catch 3005 from strap securing clamp 3000*a*. This allows strap securing clamp 3000*a* to be removed and then strap 460 to be lifted off of posts 405*a*, 405*b*. This process of removing strap securing clamp 3000*a*, while relative simple, leaves obvious evidence of damage that can be discerned by an officer monitoring an individual.

Figure 5A:
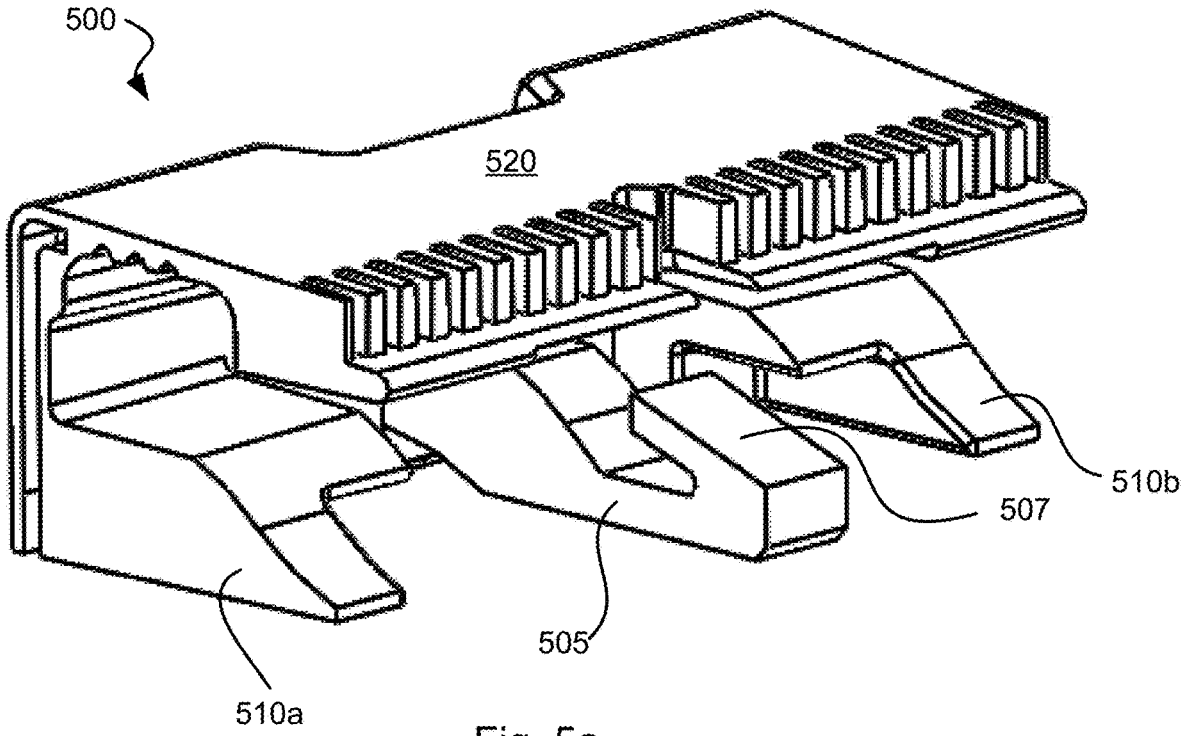
FIGS. 5*a*-5*b* depict another strap securing clamp including a single, vertical reverse prong catch in accordance with yet other embodiments of the present inventions.
Figure 5B:
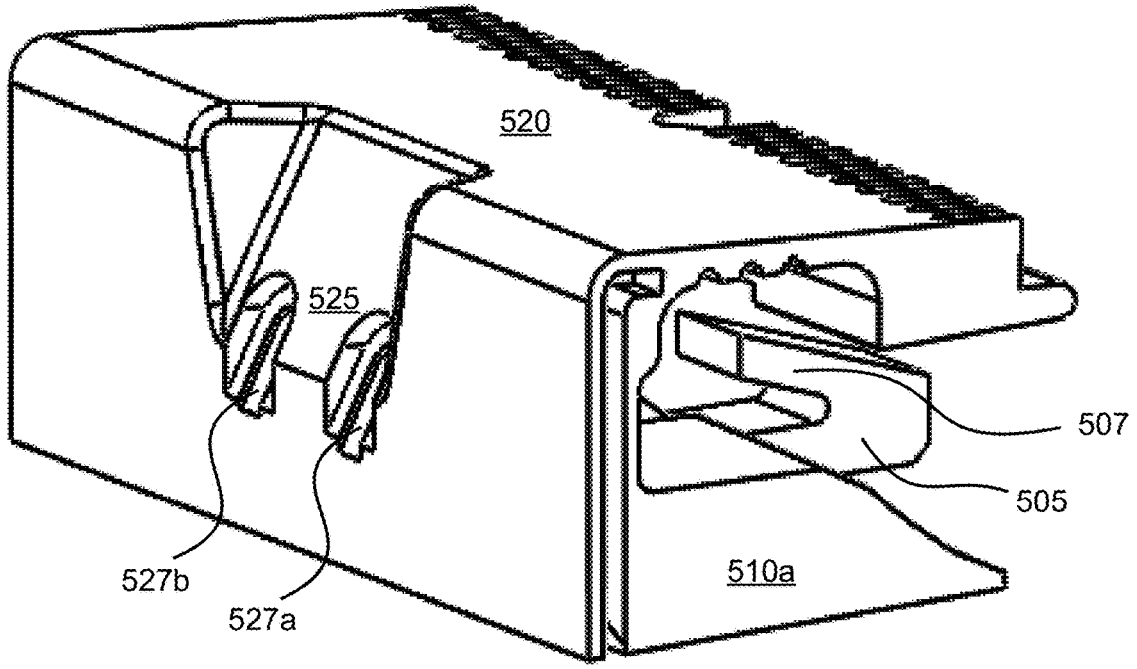

Turning to FIG. 5*a*-5*b*, a front view and a back view of another strap securing clamp 500 are shown. The front view of FIG. 5*a* shows a single, vertical reverse prong catch 505 in accordance with other embodiments of the present inventions. Single, vertical reverse prong catch 505 is made of a material that is sufficiently flexible to allow a prong 507 to deflect or collapse toward the body of single, vertical reverse prong catch 505 such that it can clear a catch post (not shown). Once prong 507 has cleared the catch post, prong 507 springs back to its original orientation such that strap securing clamp 500 cannot be removed without incurring noticeable damage. In some embodiments, single, vertical reverse prong catch 505 is made of plastic. Based upon the disclosure provided herein, one of ordinary skill in the art will recognize a variety of materials of which single, vertical reverse prong catch 505 may be made. In various embodiments, all elements of strap securing clamp 500 is made of a single material. In one particular embodiment, strap securing clamp 500 is molded of plastic.

Strap securing clamp 500 includes a top region 520 and a bottom region (not shown). As shown in FIG. 5*b*, top region 520 includes a thin walled area 525 with two targets 527*a*, 527*b*. Thin walled area 525 is above a base region of single, vertical reverse prong catch 505. A tool (not shown) may destroy a portion of thin walled area 525 exposing the base region of single, horizontal reverse prong catch 505. This same tool may then be inserted through the hole made in thin walled area 525 to sever single, vertical reverse prong catch 505 from strap securing clamp 500. With single, vertical reverse prong catch 505 severed, strap securing clamp 500 can be removed as it no longer catches on the catch post. This process of removing strap securing clamp 500, while relative simple, leaves obvious evidence of damage that can be discerned by an officer monitoring an individual. Strap securing clamp 500 further includes support members 510*a*, 510*b* that are designed to rest on a strap (not shown) that is secured by strap securing clamp 500.

Figure 6A:
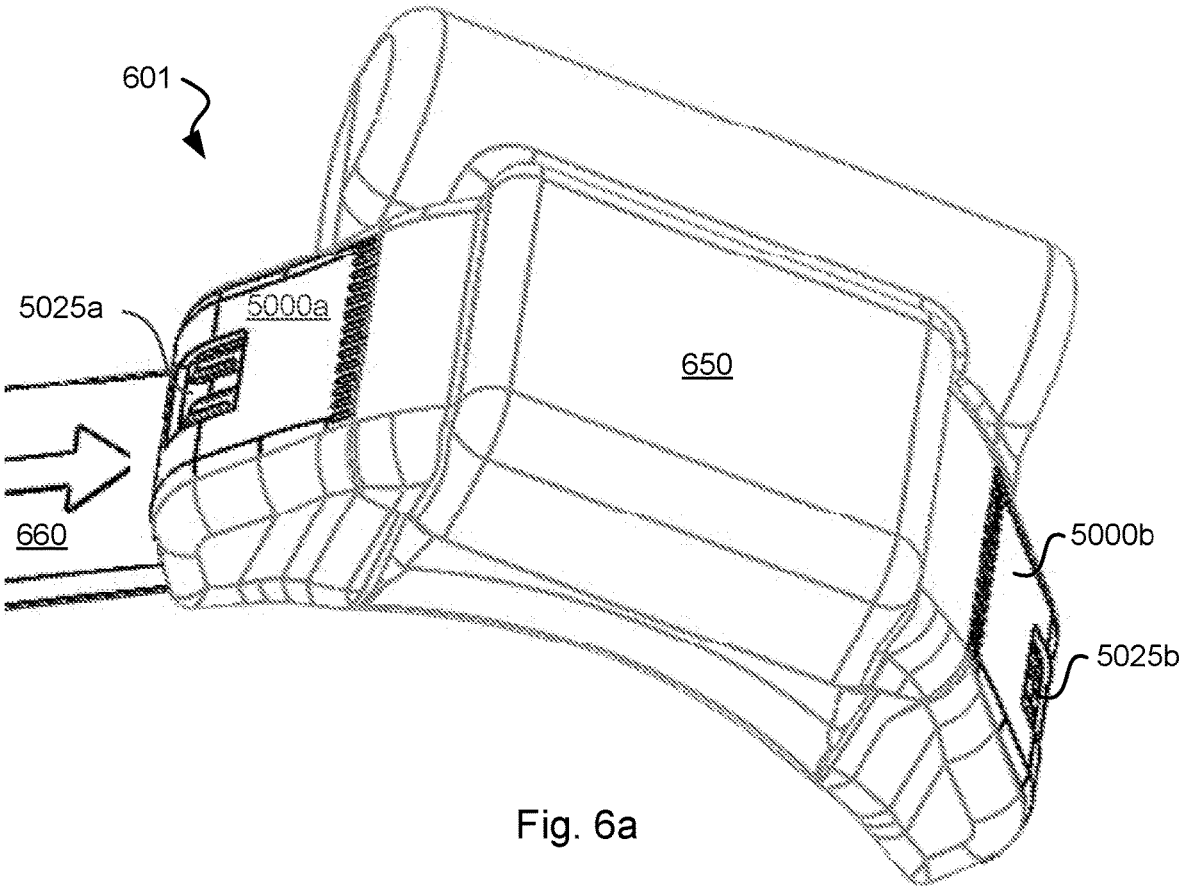
FIGS. 6*a*-6*b* show a mobile tracking device using the strap securing clamp of FIGS. 5*a*-5*b* in accordance with some embodiments of the present inventions.
Figure 6B:
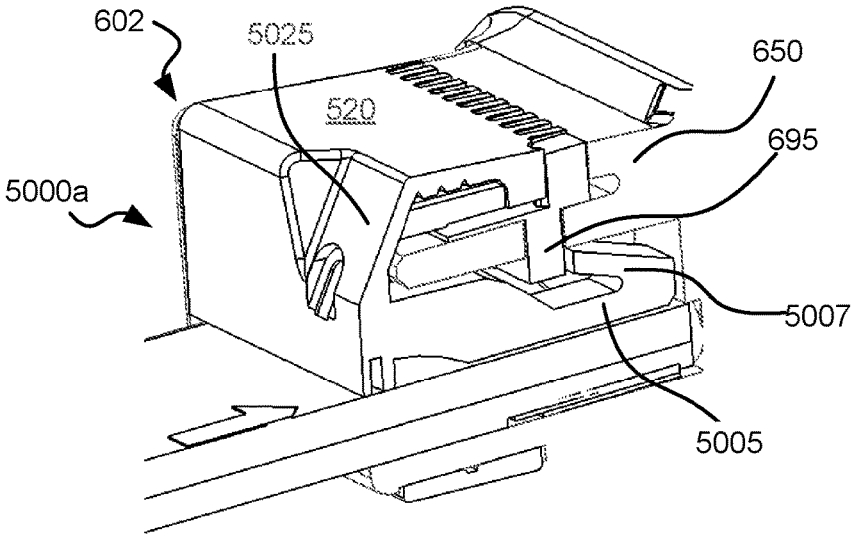

Turning to FIGS. 6*a*-6*b*, a first view 601 of a monitor device 650 where a strap 660 has been installed into monitor device 650 and secured by a strap securing clamp 5000*a* having a thin walled area 5025*a*. Another strap securing clamp 5025*a* having a thin walled area 5025*b* is installed on the opposite side of monitor device 650. While not shown, strap 660 is secured in place by posts extending up from a planar base portion of monitor device 650 similar to that discussed above in relation to FIGS. 2*a*-2*c*. Strap securing clamps 5000*a*, 5000*b* may be similar to the strap securing clamp discussed above in relation to FIGS. 5*a*-5*b*.

Turning to FIG. 6*b*, a second view 602 is shown of monitor device 650. Second view 602 particularly shows a cut away view from the side where a portion of monitor device 650, a portion of strap securing clamp 5000*a*, and a portion of strap 660 have been removed to the connection between strap securing clamp 5000*a* and monitor device 650. As shown, support members 5010*a*, 5010*b* are directly over strap 660 which has been cut away so strap securing clamp 5000*a* can be seen. A single, vertical reverse prong catch 5005 extends into monitor device 650 such that a prong 5007 catches on a catch post 695 of monitor device 650. When strap securing clamp 5000*a* is partially installed, prong 5007 deforms or collapses toward the main body of single, vertical reverse prong catch 5005 allowing prongs 5007 to extend past catch post 695 and into monitor device 650. Once prong 5007 clears catch post 695, prong 5007 that deformed during installation springs back to their normal orientation. In this fully inserted condition, prong 5007 catches on catch post 695 whenever de-insertion pressure is placed on strap securing clamp 5000*a*. As such, strap securing clamp 5000*a* is held securely in position causing holes (not shown) in strap 660 to be held in position over posts (not shown) of monitor device 650, and thus maintaining strap 660 securely fixed to monitor device 650 and around the limb of a monitored individual.

Similar to that described above in relation to FIG. 2*e*, removal of strap 660 includes opening a hole in thin walled area 5025*a*, and then extending a tool through that hole to sever single, vertical reverse prong catch 5005 from strap securing clamp 5000*a*. This allows strap securing clamp 5000*a* to be removed and then strap 660 to be lifted off of the posts. This process of removing strap securing clamp 5000*a*, while relative simple, leaves obvious evidence of damage that can be discerned by an officer monitoring an individual.

Figure 7:
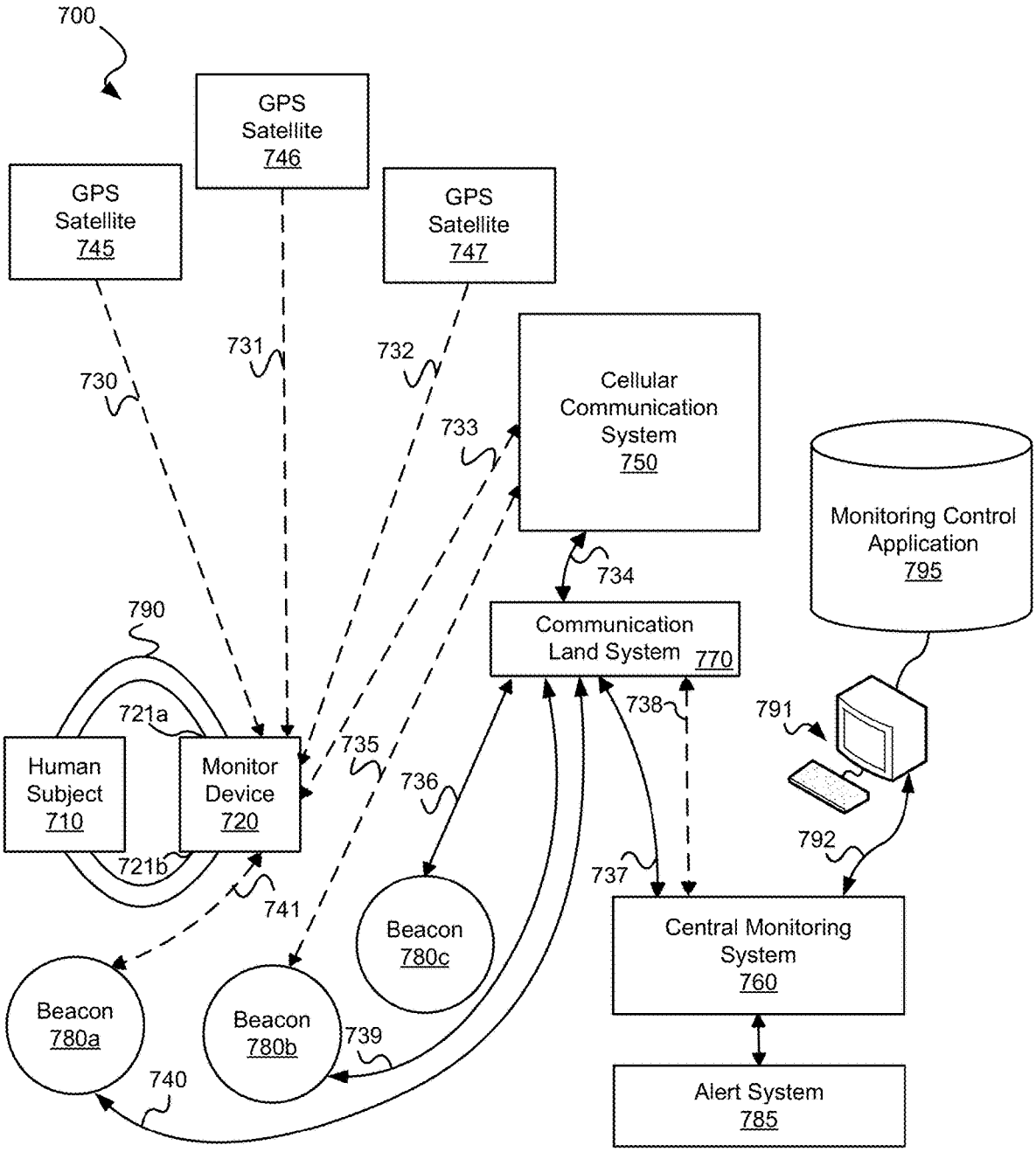
FIG. 7 shows a monitor device attached using strap securing clamps in accordance with various embodiments of the present inventions, and deployed in a monitoring system.

Turning to FIG. 7, a monitoring system 700 including a monitor device 720 attached using strap securing clamps 721*a*, 721*b* in accordance with various embodiments of the present inventions. Monitoring system 700 may be tailored for tracking human subjects, however, it should be noted that various implementations and deployments of monitoring system 700 may be tailored for tracking non-human targets such as, for example, other animals or inanimate assets or objects. Such inanimate assets or objects may include, but are not limited to, automobiles, boats, equipment, shipping containers or the like. In one particular embodiment, monitoring system 700 is tailored for tracking delivery vehicles. Based upon the disclosure provided herein, one of ordinary skill in the art will recognize a variety of individuals, animals and/or assets that may be monitored in accordance with different embodiments of the present invention, and/or different monitoring scenarios or systems that may be modified to incorporate one or more features disclosed herein.

Monitoring system 700 includes, but is not limited to, a monitor device 720 that is physically coupled to a human subject 710 by a securing device 790. In some cases, securing device 790 is a strap that includes a continuity sensor that when broken indicates an error or tamper condition. Securing device 790 is held in place by two strap securing clamps 721*a*, 721*b*. Such strap securing clamps 721*a*, 721*b* may be similar to one or more of the strap securing clamps discussed above in relation to FIGS. 1*a*-1*b*, 3*a*-3*b* and 5*a*-5*b*. Further, in some cases, monitor device 720 includes a proximity sensor that is able to detect when it has been moved away from an individual being monitored. When such movement away from the individual is detected, an error or tamper condition may be indicated. Based on the disclosure provided herein, one of ordinary skill in the art will recognize a variety of tamper sensors that may be incorporated in either monitor device 720 or securing device 790 to allow for detection of removal of monitor device 720 or other improper or unexpected meddling with monitor device 720. Further, based upon the disclosure provided herein, one of ordinary skill in the art will recognize a variety of monitors and/or securing devices that may be appropriate where the target of the monitoring is not a human or other animal subject, but rather an asset.

Monitor device 720 is designed to provide the location of human subject 710 under a number of conditions. For example, when monitor device 720 is capable of receiving wireless GPS location information 730, 731, 732 from a sufficient number of GPS satellites 745, 746, 747 respectively, monitor device 720 may use the received wireless GPS location information to calculate or otherwise determine the location of human subject 710. Alternatively or in addition, the location of a beacon 780 that is local to monitor device 720 may be used as the location of monitor device 720. As yet another alternative, an AFLT fix may be established based on cellular communication with monitor device 720. It should be noted that other types of earth based triangulation may be used in accordance with different embodiments of the present invention. For example, other cell phone based triangulation, UHF band triangulation such as Rosum, Wimax frequency based triangulation, S-5 based triangulation based on spread spectrum 900 MHz frequency signals. Based on the disclosure provided herein, one of ordinary skill in the art will recognize other types of earth based triangulation that may be used.

As yet another alternative, an AFLT fix may be established based on cellular communications between monitor device 720 and a cellular communication system 750. Furthermore, when wireless communication link 733 between monitor device 720 and cellular communications system 750 is periodically established, at those times, monitor device 720 may report status and other stored records including location fixes to a central monitoring system 760 via wireless communication link 738.

Monitoring system 700 may include, but is not limited to, at least one beacon 780. Beacons 780 are used for beacon based monitoring systems. Within FIG. 7, a telemetric wireless link 741 has been depicted between beacon 780*a* and monitor device 720. Each beacon 780 has an adjustable range to make telemetric wireless contact with monitor device 720. At any point in time, depending on each beacon's 780 relative distance to monitor device 720, none, one, or more than one tracking beacons 780 may be within transmission range of a single monitor device 720. Likewise, it is further conceivable under various circumstances that more than one monitor device 720 at times be within in range of a solitary beacon 780.

Telemetric wireless communications path 741 established at times between tracking beacon 780*a* and monitor device 720 illustrates a common feature of various different embodiments of the current invention. Some embodiments of the various inventions vary on how, i.e. protocol, and what information and/or signaling is passed over wireless link 741. For example, in more simplified configurations and embodiments, each beacon 780 is limited to repetitively transmitting its own beacon ID and physical location information. In that way, once monitor device 720 is within transmission range of tracking beacon 780*a* and establishes wireless or wired reception 741, then monitor device 720 can record and store received beacon ID and location information. At a later time, for some embodiments of the present invention, monitor device 720 can then report recorded readings from beacons 780 to the central monitoring system 760 over the cellular communication system 750 using wireless links 733 and 738 as depicted in FIG. 7. Furthermore, many embodiments allow for such transmissions and information passing to occur without being noticed by human subject 710, and unnoticed, automatically, and near effortlessly central monitoring system 760 is able to establish records and track human subject's 710 movements and whereabouts.

In other embodiments or configurations according to the present invention, each beacon 780 also transmit status information related to its own device health and information related from each beacon's 780 internal tampering, movement, or other sensors via a communication system 770 to central monitoring system 760. This allows for detection of movement of beacons 780, and establishing some level of confidence that the location reported by each of beacons 780 is accurate. Various other details about a beacon based system are disclosed in U.S. Patent Application No. 72/041,746 entitled "Beacon Based Tracking Devices and Methods for Using Such" and filed Mar. 4, 2008 by Buck et al. The entirety of the aforementioned reference is incorporated herein by reference for all purposes.

Likewise, in some other embodiments, each monitor device 720 contains a host of their own tampering, shielding, movement, and/or other sensors related to its own device health. While still further embodiments also include a host of other measurement transducers within monitor device 720 for extracting information, and for later reporting, related to physical properties of human subject 710. For example, measuring for the presence of alcohol and/or other drugs present in human subject 710 may be included in some embodiments of monitor device 720. As one example, the alcohol sensor discussed in U.S. Patent Application No. 72/041,765 entitled "Transdermal Portable Alcohol Monitor and Methods for Using Such" and filed by Cooper et al. on Mar. 4, 2008. The entirety of the aforementioned reference is incorporated herein by reference for all purposes.

Beacons 780 in alternative embodiments of the present invention may communicate with central monitoring system 760 independently of monitor device 720. The monitoring system 700 illustrated in FIG. 7 shows beacon 780*b* having both a wireless communication link 735 with cellular communication system 750, and also illustrates beacon 780*b* having a hardwired communication link 739 with land communication system 770. Monitoring system 700 is also shown with beacons 780*a*, 780*b*, and 780*c* each having hardwired land communication links 740, 739, and 736 respectively to land communication system 770. Monitoring system 700 further illustrates land communication system 770 having a hardwired communication link 734 to cellular communication system 750, and a hardwired communication link 737 to central monitoring system 760.

In some embodiments of the present invention, beacons 780 are located in areas frequented by human subject 710 where monitor device 720 is incapable of accessing information from the GPS system. Such beacons eliminate the need to perform an AFLT fix and avoid the costs associated therewith. As an example, human subject 710 may have a tracking beacon 780 placed within his home, and one also placed at his place of employment in close proximity to his work area. In this way, the two placed beacons, each at different prescribed times, can interact with his attached monitor device 720 to periodically make reports to central monitoring system 760 to track movements and the whereabouts of human subject 710. All this can be done without incurring the costs associated with performing an AFLT fix.

Monitoring system 700 further includes a control station 791 that is communicably coupled to central monitoring system 760 via a communication link 792. In one particular embodiment of the present invention, control station 791 is a personal computer including a display device, a processor, and/or one or more I/O devices. Based upon the disclosure provided herein, one of ordinary skill in the art will recognize a variety of systems that may be used as control station 791. A storage medium 795 is communicably coupled to control station 791 and maintains instructions governing the operation of monitoring control applications.

In conclusion, the present invention provides for novel systems, devices, and methods for monitoring individuals and/or assets. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A monitoring system, the monitoring system comprising:

a monitor device including at least one strap post and at least one catch post;

a strap having a hole, wherein the hole is placed over the strap post; and a strap securing clamp, wherein the strap securing clamp includes:

a reverse prong catch having at least one prong, wherein the prong extends past the catch post securing the strap securing clamp in place relative to the monitor device; and a thin walled area having a thinner wall than a surrounding portion of the strap securing clamp, wherein the reverse prong catch is exposable via the thin walled area.

2. The monitoring system of claim 1, wherein the prong is made of a material sufficiently flexible to allow the prong to deform during installation of the strap securing clamp and to return to an original orientation once the prong extends past the catch post.

3. The monitoring system of claim 2, wherein the material is plastic.

4. The monitoring system of claim 1, wherein the prong extends away from the reverse prong catch less than ninety degrees.

5. The monitoring system of claim 1, wherein the prong extends away from the reverse prong catch less than seventy degrees.

6. The monitoring system of claim 1, wherein the prong extends away from the reverse prong catch less than forty-five degrees.

7. The monitoring system of claim 1, wherein de-installing the strap securing clamp includes severing the reverse prong catch from the strap securing clamp.

8. The monitoring system of claim 1, wherein the prong of the reverse prong catch is a first prong, and wherein the reverse prong catch further includes a second prong extending from the reverse prong catch in a direction opposite that of the first prong.

9. The monitoring system of claim 1, wherein the prong extends a direction from the reverse prong catch that is selected from a group consisting of: horizontal, and vertical.

10. A monitoring system, the monitoring system comprising:

a monitor device including a strap and a strap securing clamp, wherein the strap securing clamp includes:

a reverse prong catch having at least one prong, wherein the prong extends away from the reverse prong catch less than ninety degrees in an original orientation, wherein the prong is deformable under a pressure such that it extends away from the reverse prong catch less than thirty degrees, and wherein the prong springs back to the original orientation when the pressure is removed; and a thin walled area adjacent the reverse prong catch such that a hole made in the thin walled area provides access to the reverse prong catch.

11. The monitoring system of claim 10, wherein the prong is made of deformable plastic having memory.

12. The monitoring system of claim 10, wherein the prong of the reverse prong catch is a first prong, and wherein the reverse prong catch further includes a second prong extending from the reverse prong catch in a direction opposite that of the first prong.

13. The monitoring system of claim 10, wherein the monitor device further comprises at least one catch post.

14. The monitoring system of claim 13, wherein the prong extends past the catch post securing the strap securing clamp in place relative to the monitor device.

15. The monitoring system of claim 10, wherein de-installing the strap securing clamp includes severing the reverse prong catch from the strap securing clamp.

16. A monitoring system, the monitoring system comprising:

a monitor device including a strap and a strap securing clamp, wherein the strap securing clamp includes:

a reverse prong catch having at least one prong, wherein the prong extends away from the reverse prong catch less than ninety degrees in an original orientation, wherein the prong is deformable under a pressure such that it extends away from the reverse prong catch less than seventy degrees, and wherein the prong springs back to the original orientation when the pressure is removed; and a thin walled area adjacent the reverse prong catch through which access to the reverse prong catch can be had.

17. The monitoring system of claim 16, wherein the monitor device further comprises: at least one catch post, wherein the prong extends past the catch post securing the strap securing clamp in place relative to the monitor device.

18. The monitoring system of claim 10, wherein the prong extends away from the reverse prong catch less than seventy degrees in an original orientation.

19. The monitoring system of claim 10, wherein the monitor system further comprises:

a strap having at least one hole that aligns with a strap post included as part of the monitor device.

* * * * *